US012630929B2

(12) United States Patent
Junge

(10) Patent No.: US 12,630,929 B2
(45) Date of Patent: May 19, 2026

(54) METHOD FOR PRODUCING A FLAT STEEL PRODUCT HAVING A PROTECTIVE ZINC-BASED METAL LAYER AND A PHOSPHATING LAYER PRODUCED ON A SURFACE OF THE PROTECTIVE METAL LAYER AND FLAT STEEL PRODUCT OF THIS TYPE

(71) Applicant: ThyssenKrupp Steel Europe AG, Duisburg (DE)

(72) Inventor: Fabian Junge, Düsseldorf (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 728 days.

(21) Appl. No.: 17/784,436

(22) PCT Filed: Dec. 10, 2020

(86) PCT No.: PCT/EP2020/085591
§ 371 (c)(1),
(2) Date: Jun. 10, 2022

(87) PCT Pub. No.: WO2021/116318
PCT Pub. Date: Jun. 17, 2021

(65) Prior Publication Data

US 2023/0002877 A1 Jan. 5, 2023

(30) Foreign Application Priority Data

Dec. 13, 2019 (DE) ..... 10 2019 134 298.8

(51) Int. Cl.

| | |
|---|---|
| ***C23C 22/18*** | (2006.01) |
| ***C23C 2/06*** | (2006.01) |
| ***C23C 2/26*** | (2006.01) |
| ***C23C 2/40*** | (2006.01) |
| ***C23C 22/80*** | (2006.01) |
| ***C23C 28/00*** | (2006.01) |
| ***C23G 1/10*** | (2006.01) |

(52) U.S. Cl.
CPC ..... *C23C 22/184* (2013.01); *C23C 2/06* (2013.01); *C23C 2/26* (2013.01); *C23C 2/40* (2013.01); *C23C 22/80* (2013.01); *C23C 28/321* (2013.01); *C23C 28/34* (2013.01); *C23G 1/10* (2013.01)

(58) Field of Classification Search
CPC .... C23C 2/06; C23C 2/26; C23C 2/40; C23C 28/34; C23C 28/3225; C25D 5/48
See application file for complete search history.

(56) References Cited

U.S. PATENT DOCUMENTS 3,864,139 A * 2/1975 Heller ..... C23C 22/80 106/287.19
5,160,551 A 11/1992 Rein et al.
5,268,036 A * 12/1993 Neubauer ..... B08B 3/102 134/40
6,231,688 B1 * 5/2001 Ishii ..... C23C 22/365 252/396
9,920,430 B2 3/2018 Riener et al.
2017/0029954 A1 * 2/2017 Junge ..... C23F 17/00
2018/0355470 A1 * 12/2018 Gaydos ..... C22C 21/16

FOREIGN PATENT DOCUMENTS

| | | | | |
|---|---|---|---|---|
| CN | 106471157 | A | 3/2017 | |
| DE | 3734596 | A1 | 4/1988 | |
| DE | 4416619 | A1 | 11/1995 | |
| DE | 102018203208 | A1 | 9/2019 | |
| EP | 0454211 | B1 | 6/1994 | |
| EP | 0759097 | B1 | 8/1998 | |
| EP | 1350865 | A2 | 10/2003 | |
| EP | 2824213 | A1 | 1/2015 | |
| JP | 6050175 | A | 3/1985 | |
| JP | 63227786 | A | 9/1988 | |
| JP | S6411985 | A * | 1/1989 | ..... B23Q 1/26 |
| JP | 5195245 | A | 8/1993 | |
| JP | 8302480 | A | 11/1996 | |
| JP | 9235680 | A | 9/1997 | |
| JP | 2018095907 | A * | 6/2018 | |
| WO | 9303198 | A1 | 2/1993 | |
| WO | 9914397 | A1 | 3/1999 | |

OTHER PUBLICATIONS

Univar Solutions, Safety Data Sheet Acetic Acid 20%, Mar. 19, 2024, pp. 1-10 (Year: 2024).*
DIN EN 10152, Electrolytically zinc coated cold rolled steel flat products for cold forming—Technical delivery conditions, Oct. 2015.
DIN EN 10268, Cold rolled steel flat products with hig yield strength for cold forming—Technical delivery conditions, Dec. 2013.
DIN EN 10346, Continuously hot-dip coated steel flat products for cold forming—Technical delivery conditions, Oct. 2015.

(Continued)

*Primary Examiner* — Jonathan Johnson
(74) *Attorney, Agent, or Firm* — The Webb Law Firm

(57) ABSTRACT

A method for the production of a flat steel product including at least the following steps, completed in a continuous process:

providing a flat steel product, wherein a protective metal layer of Zn, a Zn—Al alloy, a Zn—Mg alloy or a Zn—Mg—Al alloy is applied to at least one side by hot dip coating;

at least partly removing a native oxide layer present on the surface of the protective metal layer by wetting this surface with an acidic solution of sulfuric acid, sulfurous acid, hydrochloric acid, phosphoric acid, phosphonic acid, nitric acid, formic acid, oxalic acid, acetic acid, citric acid, malic acid, tartaric acid, nitrous acid or hydrofluoric acid;

activating the surface of the protective metal layer by applying an aqueous activation solution to the surface of the protective metal layer;

and phosphating the activated surface of the protective metal layer by applying an aqueous phosphating solution to the activated surface.

20 Claims, 5 Drawing Sheets

(56) References Cited

OTHER PUBLICATIONS

Pietschmann, Judith, Industrial Powder Coating—Basics—Methods—Practical Use, 2013, 4th Ed., Wiesbaden, Springer Vieweg.
Thyssenkrupp Steel Europe AG, Product overview: Steels for the automotive industry—product information, Aug. 2018, version 0, Duisburg, Germany.
Thyssenkrupp Steel Europe AG, Steel DP-W and DP-K—product information for dual-phase steels, May 2022, version 1, Duisburg, Germany.
VDA Material Sheet, VDA 239-100, Sheet Steel for Cold Forming, May 2016.
Zinc-Magnesium-Aluminium Coatings for Automotive Industry, 2013, First Edition, Steel Institute VDEh, Düsseldorf.

* cited by examiner

METHOD FOR PRODUCING A FLAT STEEL PRODUCT HAVING A PROTECTIVE ZINC-BASED METAL LAYER AND A PHOSPHATING LAYER PRODUCED ON A SURFACE OF THE PROTECTIVE METAL LAYER AND FLAT STEEL PRODUCT OF THIS TYPE

CROSS-REFERENCE TO RELATED APPLICATIONS

This application is the United States national phase of International Application No. PCT/EP2020/085591 filed Dec. 10, 2020, and claims priority to German Patent Application No. 10 2019 134 298.8 filed Dec. 13, 2019, the disclosures of which are hereby incorporated by reference in their entirety.

BACKGROUND OF THE INVENTION

Field of the Invention

The invention relates to a method for producing a flat steel product having a protective zinc-based metal layer and a phosphating layer produced on a surface of the protective metal layer.

The invention further relates to a flat steel product having a protective zinc-based metal layer and a phosphating layer produced on a surface of the protective metal layer.

Background of the Invention

Flat steel products are understood here as rolled products of which the length and width are each significantly greater than their thickness. Thus, when a flat steel product or a "sheet metal product" is mentioned below, this means rolled products such as steel strips or sheets, from which blanks or sheet metal blanks are separated for the production of bodywork components, for example.

"Shaped sheet metal parts" or "sheet metal components" are made from such flat steel or sheet metal products, with the terms "shaped sheet metal part" and "sheet metal component" being used synonymously herein.

The terms "phosphating layer," "phosphate layer," "phosphate crystal layer" and "phosphate coating" are also to be understood synonymously in the following.

As used herein, the term "phosphorus crystal" refers to all crystals formed from compounds containing phosphorus. These include, in particular, the zinc phosphate crystals which form during phosphating of a Zn coating.

"Protective zinc-based metal layer," "Zn coating" or "Zn protective layer" are used here to refer to all protective layers which are made of pure zinc in the technical sense or of a Zn alloy, in particular a Zn—Al alloy, a Zn—Mg alloy or a Zn—Mg—Al alloy.

Protective zinc-based metal layers are applied to the steel substrate of each flat steel product as protection against corrosion.

The production of a phosphate layer on a flat steel product provided with a so-called "ZM coating" is of particular importance for the application of the method according to the invention explained herein.

As explained in detail in the brochure "ZINC-MAGNESIUM-ALUMINIUM COATINGS FOR AUTOMOTIVE INDUSTRY," First Edition 2013, published by the Steel Institute VDEh, Düsseldorf, and available for download at the URL https://www.stahl-online.de/wp-content/uploads/2013/08/ZM-Coatings-for-Automotive-Industry.pdf, metal Zn—Mg—Al coatings, with which flat steel products of the type in question here are coated, typically contain in total up to 8 wt. % Mg and Al. Different phases such as Zn, MgZn2, Al-rich Zn, which each contribute to the protective effect of the protective coating, are present in such a protective layer, which is also referred to as a "ZM protective coating" or "ZM coating" in technical jargon and in the present text. The Al content typically varies from 0.3-5 wt. %, while the Mg content is typically 0.3-3 wt. %.

The optimized protective effect achieved through the special distribution of phases containing Zn, Mg and Al in the protective layer allows for minimized layer thicknesses while at the same time maximizing protection against corrosion. This not only contributes to improving the forming behavior, but also to conserving the resources required to produce corrosion protection. This opens up a multitude of applications for flat steel products provided with ZM coatings, for example in the field of producing vehicle bodywork and comparable applications in which ZM-coated metal sheets used as the starting product are formed into the relevant component at high degrees of forming.

A phosphating layer produced on Zn-coated flat steel products contributes to the protection against corrosion and improves the adhesion of a coat of paint which is applied to the flat steel product provided with the phosphating layer or to the component formed from such a flat steel product.

In addition, in the case of flat steel products which are provided with a Zn coating produced by electrolytic deposition, the phosphating layer applied to the Zn coating is also used as a forming aid when forming the flat steel product into shaped sheet metal parts, such as those required for producing automobile bodywork. Here, phosphating ensures improved formability, since flat steel products which have phosphating on their protective metal layer leave behind less abrasion in the forming tool and exhibit improved sliding behavior.

The general procedure for phosphating steel products coated with an alloy layer is described, for example, in EP 0 454 211 B1, in the specialist book by Judith Pietschmann "Industrial Powder Coating—Basics—Methods—Practical Use," 4th Ed., Wiesbaden, Springer Vieweg, 2013, and in DE 37 34 596 A1. The methods explained therein provide for the sequence of work steps "cleaning the surface of the steel product of production residues and oxides or the like using an alkaline or acidic cleaner," "rinsing the cleaned surface of the steel product" and "activating the rinsed surface of the steel product."

During phosphating, the zinc from the protective metal layer is converted to zinc phosphate in a redox reaction with the formation of hydrogen gas, with the zinc phosphate forming directly on the surface of the coating of the flat steel product and thus being joined to said surface in a particularly stable manner.

Conventionally, phosphating layers are produced in a two-stage process. In the first step of this process, the surface is activated by applying so-called activation particles to the flat steel product by means of contact with a suitable dispersion. The activation particles are intended to be used as crystallization nuclei for the zinc phosphate crystals produced in the following work step and lead to smaller and more densely packed crystals.

So that zinc phosphate crystals can separate and grow, in the second step of conventional phosphating, a phosphating solution (consisting of, inter alia, phosphoric acid, water and zinc), which is close to solution equilibrium, is brought into contact with the surface of the protective coating on the relevant flat steel product. When the phosphoric acid solution comes into contact with the zinc surface, zinc dissolves from the surface of a Zn-coated flat steel product. As a result, the solubility of zinc phosphate in the phosphating solution is exceeded directly on the surface of the protective Zn coating and zinc phosphate crystals form. The resulting zinc phosphate crystals are homogeneously distributed over the surface of the protective zinc coating and follow the roughness of the steel substrate of the flat steel product.

So far, in practice, it has only been possible to electrolytically phosphate surfaces provided with the Zn coating in a continuous process. Surfaces of flat steel products provided with the Zn coating by hot-dip coating ("hot-dip galvanizing"), however, could previously only be phosphated after they had been formed into sheet metal components. For example, when producing automobile bodywork, it has previously been customary for the hot-dip galvanized metal sheets to be delivered in the unphosphated state from the producer of the flat steel product to the producer of the automobile bodywork who forms the flat steel products into components and then provides the components obtained with the phosphating layer in a dipping process. This requires significantly longer process times than are possible during continuous phosphating of strip material. In addition, with this procedure, the phosphating layer is not available as a forming aid when forming the relevant sheet metal component.

In the case of ZM coatings applied by hot-dip galvanizing, the reason why nowadays only electrolytically Zn-coated flat steel products are phosphated in a continuous process as strip material is that the aluminum and/or magnesium oxide layers are significantly more resistant to attack by the phosphating solution than a Zn coating produced by electrolytic galvanizing. Zinc oxide, which forms on the surface of a protective Zn layer produced by electrolytic galvanizing, is dissolved very quickly by the phosphating solution. As a result, the conversion process, in which metal zinc is dissolved from the surface and, together with phosphate from the phosphating solution, precipitates as zinc phosphate and begins to grow on the zinc surface, can start very quickly.

In contrast, in the case of a protective Zn layer applied by hot-dip coating and containing Mg and/or Al, the addition of a fluoride-containing component is necessary for dissolving the aluminum or magnesium oxides present on the surface of the protective layer. However, the process of dissolving the Al or Mg oxides takes several seconds, and therefore the conversion process which is crucial for the formation of the phosphating layer can only start comparatively late. Thus, in order to dissolve the Al and/or Mg oxide layer, it is typically necessary to expose the relevant flat steel product to the phosphating solution for a wetting period of more than 10 s. Such long wetting times cannot be achieved with conventional phosphating processes which are carried out continuously. Therefore, when processing hot-dip galvanized flat steel products, it has previously only been economically possible in industrial practice to form sheet metal components from non-phosphated flat steel products and then to phosphate the components obtained piece-by-piece using a dipping method.

EP 2 824 213 A1 discloses a method for improving the adhesion of a steel sheet provided with a protective Zn—Mg—Al-based coating, in which method a protective Zn—Mg—Al-based coating is applied in a continuous process and then the oxide layer comprising $Al_2O_3$ and MgO is modified without pickling it. For this purpose, the protectively coated steel sheet is first skin-passed and then treated with an aqueous fluoride-containing composition to reduce the MgO content.

WO 99/14397 A1 describes a method for phosphating steel strip or steel strip which is galvanized on one or both sides or is alloy-galvanized by spraying or dipping it for a period of from 2 to 20 seconds with an acidic zinc, magnesium and manganese-containing phosphating solution at a temperature of 50 to 70° C.; the phosphating solution is characterized by its specific composition. However, the strip phosphating method described in WO 99/14397 A1 is not directed to flat steel products having a protective Zn—Mg—Al-based layer.

Against the background of the prior art explained above, the problem has arisen of providing a method which is suitable for continuous phosphating of flat steel products, the protective metal layer of which has been applied to the relevant flat steel product by hot-dip coating ("hot-dip galvanizing"), the protective metal layer being formed in particular from a Zn alloy containing Al and/or Mg.

SUMMARY OF THE INVENTION

A method according to the invention for producing a flat steel product having a protective zinc-based metal layer and a phosphating layer produced on a surface of the protective metal layer comprises, according to the invention, at least the following method steps which are carried out in a continuous process:

a) providing a flat steel product, wherein a protective metal layer formed from Zn, a Zn—Al alloy, a Zn—Mg alloy or a Zn—Mg—Al alloy is applied to at least one side by hot dip coating;
b) at least partly removing a native oxide layer present on the surface of the protective metal layer by wetting this surface with an acidic solution having a pH of 1-3.5 for a wetting period of 1-60 s, wherein, for the acidic solution, an acid from the group "sulfuric acid, sulfurous acid, hydrochloric acid, phosphoric acid, phosphonic acid, nitric acid, formic acid, oxalic acid, acetic acid, citric acid, malic acid, tartaric acid, nitrous acid or hydrofluoric acid" is used;
c) optionally rinsing the surface of the protective metal layer wetted with the acidic solution with an aqueous rinsing solution;
d) activating the surface of the protective metal layer by applying an aqueous activation solution to the surface of the protective metal layer;
e) phosphating the activated surface of the protective metal layer by applying an aqueous phosphating solution to the activated surface of the protective metal layer.

It goes without saying that the method steps which are not mentioned here and are usually completed by a person skilled in the art in phosphating flat steel products of the type under discussion here are also additionally carried out in the method according to the invention if there is a need for this.

DESCRIPTION OF THE INVENTION

Figure 1:
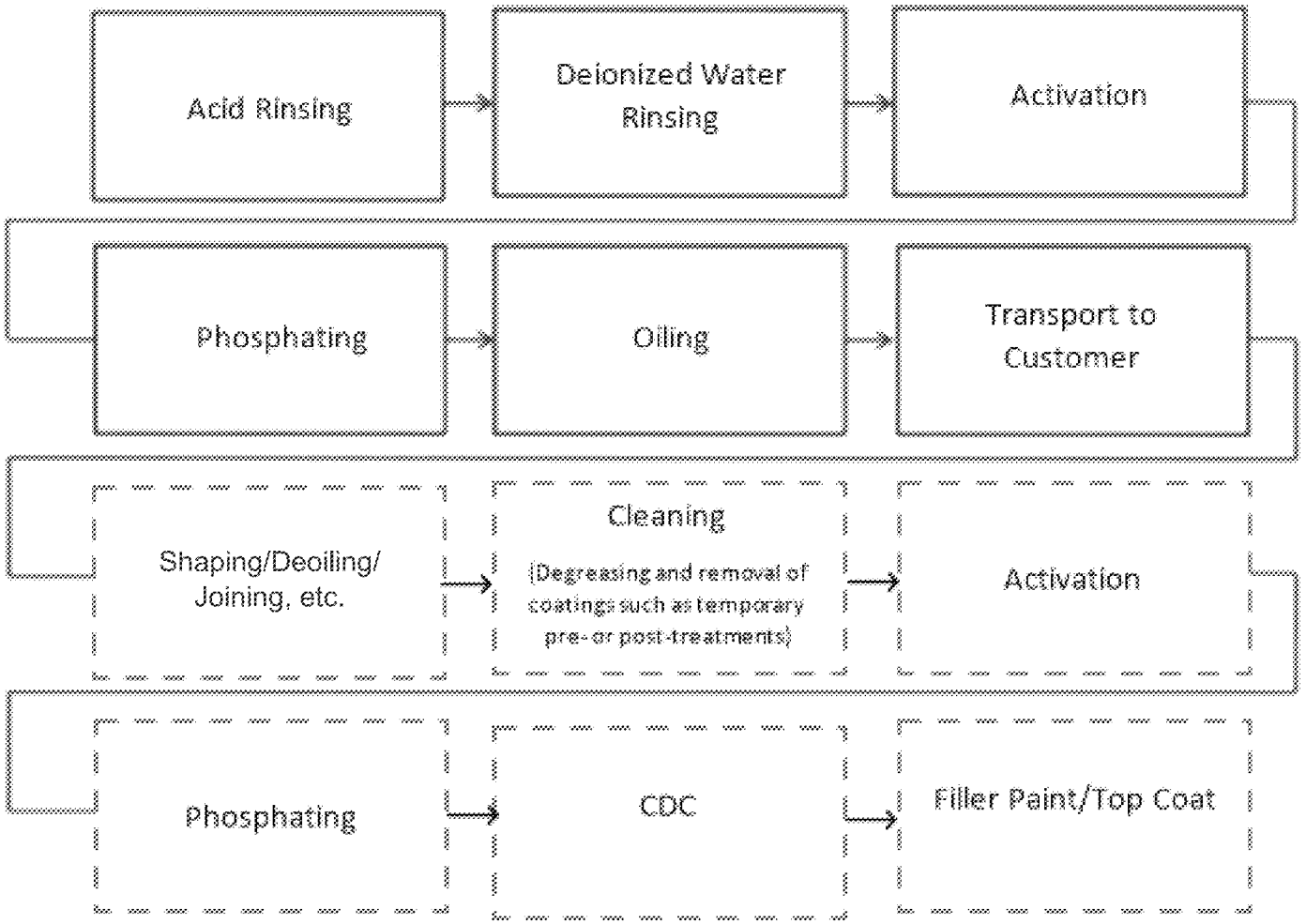
FIG. 1 shows a diagram representing the method sequence in the automotive-typical processing of a flat steel product using the method according to the invention.

The present invention is directed to a method for producing a flat steel product having a protective zinc-based metal layer and a phosphating layer produced on a surface of the protective metal layer, comprising, at least the following method steps which are carried out in a continuous process:

a) providing a flat steel product, wherein a protective metal layer formed from Zn, a Zn—Al alloy, a Zn—Mg alloy or a Zn—Mg—Al alloy is applied to at least one side by hot dip coating;

b) at least partly removing a native oxide layer present on the surface of the protective metal layer by wetting this surface with an acidic solution having a pH of 1-3.5 for a wetting period of 1-60 s, wherein, for the acidic solution, an acid from the group "sulfuric acid, sulfurous acid, hydrochloric acid, phosphoric acid, phosphonic acid, nitric acid, formic acid, oxalic acid, acetic acid, citric acid, malic acid, tartaric acid, nitrous acid or hydrofluoric acid" is used;

c) optionally rinsing the surface of the protective metal layer wetted with the acidic solution with an aqueous rinsing solution;

d) activating the surface of the protective metal layer by applying an aqueous activation solution to the surface of the protective metal layer;

e) phosphating the activated surface of the protective metal layer by applying an aqueous phosphating solution to the activated surface of the protective metal layer.

The invention is therefore based on a flat steel product which is produced in a conventional manner and is provided with a protective Zn layer in an equally conventional manner by hot-dip coating, also known as "hot-dip galvanizing."

Here, the invention makes it possible to produce a finely crystalline phosphate layer on a flat steel product treated according to the invention, as could only be achieved in the prior art on flat steel products provided with a Zn protective coating by electrolytic galvanizing.

The advantages of the procedure according to the invention for producing a phosphating layer on the protective Zn layer of a flat steel product mean that the procedure can also be used with protective Zn layers which have been produced from pure zinc in the technical sense, i.e., where substantially only Zn oxides are present on the surface of the protective metal layer before phosphating.

However, the method according to the invention is particularly suitable for producing flat steel products, of which the protective Zn layer is formed from a Zn alloy in which magnesium (Mg) and/or aluminum (Al) is present in effective amounts in addition to zinc, in order to optimize the properties of the protective Zn layer. Such Zn—Al, Zn—Mg or Zn—Mg—Al coatings can be produced particularly economically by hot dip coating on the steel substrate of the relevant flat steel product and have Al and/or Mg oxides on their surface, due to which, for the reasons explained above, flat steel products coated with such Zn alloy layers as a protective metal layer cannot be phosphated economically using conventional methods.

Work step b), in which the flat steel product provided in work step a) of the method according to the invention and provided with the Zn coating is treated with an acidic solution before the actual phosphating step (step e)), is crucial for the procedure according to the invention when phosphating a flat steel product. This ensures that the native oxide layer present on the free surface of the protective Zn layer of the provided flat steel product is removed. The aim is the complete removal of the oxide layer in the technical sense.

The pretreatment with the acidic solution provided according to the invention allows the zinc oxide components on the surface of the Zn coating to dissolve. Said pretreatment with an acidic solution also makes it possible to effectively remove the aluminum oxide and magnesium oxide components on the surface of the protective metal layer. After work step b) of the method according to the invention, the amounts of metal oxide components on the surface of the Zn coating of the flat steel product are at most so small that the conversion process required to form the phosphating layer can be started immediately during the subsequent phosphating (step e)). The phosphating solution applied in phosphating step e) comes into direct contact with the non-oxidized zinc on the surface of the protective metal layer so that the chemical conversion processes for forming the phosphate crystals forming the phosphating layer can start directly.

The pretreatment with the acidic solution provided according to the invention thus produces a status of the flat steel product to be covered with the phosphating layer according to the invention, which is otherwise only obtained when flat steel products of which the Zn coating has been deposited on the steel substrate of the flat steel product by electrolytic deposition are processed.

In this way, the method according to the invention makes it possible, in the phosphating step (step e) of the method according to the invention, to produce a dense phosphate layer within the time periods typical of continuously run phosphating processes.

The procedure according to the invention therefore even makes it possible to phosphate the flat steel products which have been provided with a Zn coating, in particular a Zn—Al, a Zn—Mg or a Zn—Mg—Al coating, by means of hot-dip galvanizing economically and in a continuous process before they are deformed into sheet metal parts.

The short treatment times made possible by the invention in the phosphating step (work step e) of the method according to the invention) allow flat steel products, which are provided with a protective Zn-based metal layer and a phosphating layer thereon and in which the phosphate crystals of the phosphating layer are particularly small and densely distributed, to be produced.

A flat steel product according to the invention having a protective zinc-based metal layer and a phosphating layer produced on a surface of the protective metal layer is characterized in that its phosphating layer consists of phosphate crystals having an average crystal diameter of from 0.5-5 μm. In this case, flat steel products according to the invention can be produced in particular using a method according to the invention.

Their small size makes the phosphate crystals mechanically more stable with regard to their connection to the protective Zn layer. In addition, the phosphate crystals of the phosphating layer created or produced according to the invention have a larger total surface area than the coarser crystal structures which result from conventional batch phosphating of components. As a result, flat steel products provided with a phosphating layer according to the invention have better adhesion for painting or gluing components formed from the flat steel products according to the invention than conventionally phosphated components. At the same time, the small phosphate crystals of a phosphating layer produced on a flat steel product according to the invention bring about a homogenization of the surface of the flat steel product and, associated therewith, improved behavior during cold forming in a forming tool.

Since the metal oxides deposited on the surface of the Zn coating are removed according to the invention by the pretreatment with the acidic solution (work step b) of the method according to the invention), there is no need to add environmentally harmful fluorides and other additives to the phosphating solution. In addition, the content of heavy metals such as nickel and manganese in the phosphating solution can be reduced because smaller zinc phosphate crystals are formed. The procedure according to the invention is therefore also characterized by improved environmental compatibility and simpler handling.

If components produced by forming flat steel products which are coated with a phosphating layer according to the invention are to be subjected to phosphating using the conventional production process after being formed, this phosphating of the component can be aimed at compensating for damage or imperfections in the phosphating layer produced according to the invention on the flat steel product before it is formed into the component so that an optimal surface condition is achieved for subsequent processing, in particular painting or gluing. For this purpose, the phosphating of the component can be designed in a resource-saving manner in such a way that the phosphating layer is closed only in portions of the surface of the protective metal layer which may not be coated or are no longer optimally coated with it.

All acids which are sufficiently water-soluble and at the same time capable of dissolving the native oxide layer on the surface of the Zn coating are suitable as the acid for the acidic solution used in work step b) of the method according to the invention.

The acids from the group "sulfuric acid, sulfurous acid, hydrochloric acid, phosphoric acid, phosphonic acid, nitric acid, nitrous acid and hydrofluoric acid" are particularly suitable for this purpose. A particularly good removal of the native oxide layer can be achieved with diluted sulfuric acid as an acidic solution, which is also available at a particularly low price.

However, organic acids can also be used for the acidic solution as long as they are sufficiently strong proton donors. Organic acids from the group "formic acid, oxalic acid, acetic acid, citric acid, malic acid and tartaric acid" are also suitable for the method according to the invention.

The surface of the Zn-coated flat steel product to be provided with the phosphating layer can be wetted with the acidic solution in work step a) in any suitable manner. Particularly suitable methods for applying the acidic solution to the surface to be provided with the phosphating layer are spraying methods, coating methods or dipping methods, with the use of a conventional coating or spraying method making the method particularly efficient and economical.

The length of time that the surface of the Zn coating to be phosphated must be exposed to the acidic solution in order to remove the oxides can be influenced by varying the acid concentration of the acidic solution and the temperature of the acidic solution, as well as by the method of application.

This shows that the removal of the native oxide layer of the Zn coating according to the invention can be achieved within a wetting time of typically 1-60 s, in particular 1-30 s or 1-15 s, with a wetting time of at least 5 s proving particularly advantageous in practice. A maximum wetting time of 10 s can be achieved by using an acid that is sufficiently aggressive and present in a sufficient concentration, by using suitable system engineering or by suitably temperature-controlling the acidic solution. In any case, the wetting time required for work step b) is so short that work step b) can be integrated together with the other work steps of the method according to the invention in a continuously completed work sequence.

Suitable ranges for the concentration of the acid in an acidic solution used according to the invention can be described via the pH of the acidic solution. In order to achieve efficient removal of the native oxide layer without attacking the metal surface of the Zn coating at the same time, an acidic solution having a pH of 1-3.5 is used. If the acidic solution has a pH of more than 3.5, the acidic solution will need to be left to act for a longer period of time to dissolve the native oxide layer. Therefore, the pH is preferably limited to at most 2 or less in order to be able to remove the oxide film in a sufficiently quick time. pH values of the acidic solution in the range of from 1-1.5 have proven to be optimal.

By temperature-controlling the acidic solution when wetting the flat steel product, dissolving of the native oxide layer on the Zn coating of the flat steel product can be accelerated. Wetting temperatures of the acidic solution of from 20-95° C. are suitable for this. Suitable wetting temperatures can be determined depending on the concentration of the acidic solution and the speed at which the flat steel product runs through the section in which said product is wetted by the solution such that the native oxide layer can be removed within the available wetting time resulting from the length of the wetting path and the conveying speed. In practice, wetting temperatures of in particular 20-80° C. have proven to be particularly suitable for this purpose.

The removal of the oxides from the surface of the Zn coating of the flat steel product according to the invention is optionally followed by a rinsing step c), in which the surface of the protective metal layer wetted with the acidic solution is rinsed with an aqueous rinsing solution in order to remove any residues of the acidic solution. Tap water, process water or deionized water are suitable here as rinsing agents in the conventional manner.

The flat steel product pretreated by wetting with the acidic solution (work step b)) and the optional rinsing (optional step c)) undergoes activation of the surface of the flat steel product to be provided with the phosphating layer before phosphating (work step e)). For this purpose, an aqueous activation solution is applied to the surface of the protective metal layer to be provided with the phosphating layer (work step d)). All activation solutions already used for this purpose in the prior art are suitable as agents for the activation. These include, for example, powder activations based on sodium titanyl phosphates (titanyl phosphates) or liquid activations based on zinc phosphate/titanium phosphate/iron oxide.

A particularly finely crystalline phosphating layer is formed, which leads to a Zn-coated flat steel product having particularly good surface properties, in particular if the aqueous activation solution used for activation contains 0.8-25 g/l, in particular up to 16 g/l or up to 12 g/l, titanium salt selected from the group "titanium dioxide, titanium dioxide hydrate, dipotassium hexafluorotitanate, hexafluorotitanic acid, titanium sulfate, titanium disulfate, titanyl sulfate, titanium oxide sulfate, titanyl chloride, titanium potassium fluoride, titanium tetrachloride, titanium tetrafluoride, titanium trichloride, titanium hydroxide, titanium nitrite, titanium nitrate, potassium titanium oxide oxalate and titanium carbide." Titanium salts are particularly good crystal nuclei for the crystallization of metal phosphates such as zinc phosphate. Alternatively or additionally, the aqueous activation solution can contain at least one compound from the group "oxalic acid, Zn3(PO4)2, Zn2Fe(PO4)2, Zn2Ni(PO4)2, Zn2Mn(PO4)2, Zn2Ca(PO4)2, nickel phosphate, manganese phosphate, Calcium phosphate, iron phosphate, aluminum phosphate, cobalt (I) phosphate, cobalt (III) phosphate, copper, copper sulfate, copper nitrate, copper chloride, copper carbonate, copper oxide, silver, cobalt, nickel, Jernsted salt, lead acetate, tin chloride, tin tetrachloride, arsenic oxide, zirconium chloride, zirconium sulfate, zirconium, iron, lithium, zinc phosphate, iron phosphate, zinc oxide and iron oxide." Contents of from 0.1-10 g/l of each salt or each compound have proven to be particularly practical.

If the aqueous activation solution has a starting concentration of at least 0.1-10 g/l, the crystallization nuclei for the phosphate crystals which form in the subsequent phosphating step are formed on the surface of the protective Zn layer within a few seconds. The activation according to the invention can be carried out particularly effectively when the batch concentration is less than 10 g/l.

An activation of the surface to be phosphated that is sufficient for the purposes according to the invention reliably succeeds if the surface to be activated is exposed to the aqueous activation solution for an application time of 1-60 s.

The final phosphating step (work step e)) of the method according to the invention can be carried out in any known manner. Thus, the phosphating solutions known to a person skilled in the art are suitable for the phosphating step. A trication phosphating solution, for example, as is also already known for this purpose from the prior art, has proven to be particularly favorable with regard to the formation of a phosphate layer which ensures high paint adhesion or corrosion resistance.

Phosphating of a flat steel product which is provided and pretreated according to the invention can be reliably carried out by using an aqueous phosphating solution which contains 5-20 g/l phosphoric acid, 1-20 g/l orthophosphate and/or dihydrogen phosphate, 0.5-6 g/l zinc salt, 0.5-2 g/l manganese salt, 0.5-2 g/l nickel salt, and remainder water and unavoidable impurities.

It has proven advantageous here if the free acid content of the phosphating solution is kept within a range of from 4 to 8 points and the ratio of total acid to free acid is kept within a range of from 2.5 to 5 points. The finely crystalline phosphate crystals are particularly reliably formed with a free acid content in the range of from 5 to 7 points. It serves the same purpose if the ratio of total acid to free acid is kept within a range of from 2.8 to 4.5 points.

The activation (work step c)) and the phosphating (work step d)) can be carried out independently of one another in a regular wet-on-wet or dry-on-wet application step. The process efficiency can be further increased by a wet-on-wet method, since an intermediate drying step can be omitted. The dry-on-wet method, on the other hand, can be used particularly flexibly.

To ensure that an oxide layer does not form again on the surface of the Zn coating between the removal of the native oxide layer (work step a)) and the activation and phosphating of the Zn coating (work steps c) and d)), no more than a maximum of 300 s should elapse between the end of work step a) and the beginning of work step d).

In principle, all steels which can be coated with a protective Zn-based metal layer by using methods from the prior art can be used as the steel which comprises the steel substrate of flat steel products treated according to the invention. According to a general regulation, steels preferably used according to the invention consist of max. 0.08 wt. % C, max. 0.45 wt. % Mn, max. 0.030 wt. % P, max. 0.030 wt. % S, max. 0.15 wt. % Cr, max. 0.20 wt. % Cu, max. 0.06 wt. % Mo, max. 0.008 wt. % Nb, max. 0.20 wt. % Ni, where the sum of Cu, Ni, Cr and Mo must not exceed 0.50 wt. % and the sum of Cr and Mo must not exceed 0.16 wt. %, and remainder Fe and unavoidable impurities. The steels in question include, for example, the steels "CR3," "CR4" or "CR5" and "DX51" designated according to VDA material sheet VDA 239-100, higher-strength IF steels (e.g., the steel designated "HC180Y" according to DIN EN 10152, 10268, 10346), bake-hardening steels (e.g., the steels designated "CR180B" and "CR210B" according to the VDA material data sheet VDA 239-100), high-strength steels (e.g., the steels designated "HC340" and "HC420" according to DIN EN 10268, 10346) and high-strength dual-phase or multiphase steels, which in particular have TRIP properties. These and other possible steels are described in the brochures "Product overview: Steels for the automotive industry—product information," August 2018, version 0, and "Steel DP-W and DP-K—product information for dual-phase steels," February 2018, version 0, both issued by thyssenkrupp Steel Europe AG, Duisburg, Germany.

The zinc-based coating layers provided on the relevant steel substrate and treated in the manner according to the invention can have a composition known per se, as long as their main component is zinc. Examples of this are so-called "Z coatings," which consist of zinc and optionally 0.1-0.5 wt. % Al and the usual technically unavoidable impurities, such as iron, which have no effect on the properties of the coating. Other examples are so-called "ZF coatings," which also consist of zinc and unavoidable impurities and optionally up to 0.5 wt. % Al, but in which up to 10 wt. % Fe is also diffused out of the steel substrate into the protective coating. A third example is so-called "Galfan protective coatings," which consist of 1-5 wt. % Al and remainder zinc and unavoidable impurities such as iron, lanthanum and cerium. The protective coatings in question are usually applied by hot dip coating.

The method according to the invention is particularly suitable for the production of flat steel products which are provided with a protective Zn—Mg—Al metal layer ("ZM coating") applied to the relevant steel substrate of the flat steel product by hot-dip galvanizing and on the surface of which a phosphating layer is produced in the manner according to the invention. Typically, such flat steel products provided with a ZM coating have a zinc and magnesium-based coating on the steel substrate, which coating contains, in addition to Zn and unavoidable impurities, 0.1-3.0 wt. % Mg, preferably 0.6-2.0 wt. % Mg, 0.1-5.0 wt. % Al, preferably 0.0-2.5 wt. % Al, particularly preferably 1.0-2.0 wt. % Al, and optionally further alloying elements, such as Fe in known amounts.

A flat steel product consisting of a suitable steel and provided with a protective Zn-based coating is provided for the production sequence shown in FIG. 1 for the production of components for a vehicle body.

The first "acid rinsing" step in FIG. 1 can, if necessary, be preceded by a conventional degreasing step in order to remove residues adhering to the relevant flat steel product and originating from previous steps in the production of the flat steel product.

In the "acid rinsing" step, this flat steel product is rinsed with an acidic solution in order to remove the native oxide layer present on the surface of the protective metal layer of the flat steel product.

The flat steel product then goes through the "deionized water rinsing" step, in which said product is rinsed with deionized water to remove residues of the previously used acidic rinsing solution.

In the following "activation" work step, the surface of the protective coating is activated by applying an aqueous activation solution to the surface of the protective metal layer.

Then, in the "phosphating" step, the previously activated surface of the protective layer is phosphated by applying an aqueous phosphating solution to the activated surface.

To protect against environmental influences, the flat steel product is oiled with a conventional protective oil after phosphating ("oiling" work step) and the flat steel product oiled in this way is transported to the customer ("transport to customer" work step).

The work steps "forming/de-oiling/joining, etc.," "cleaning," "activation," "phosphating," "CDC" (CDC="cathodic dip coating"), "filler paint/top coat," which are completed by the customer, i.e., the processor of the flat steel product and highlighted by dashed rectangles in FIG. 1, correspond in their type and sequence to the conventional procedure and are therefore not explained in detail here.

To test the effect of the invention, samples E1, E2 and R were separated from flat steel products produced in a conventional manner. The steel substrate of the flat steel products consisted in each case of a commercially available steel under the designation M3A33, the composition of which is given in Table 1.

TABLE 1

| C | Si | Mn | P | S | Al | Cr | Mo |
|---|---|---|---|---|---|---|---|
| 0.003 | 0.02 | 0.15 | 0.01 | 0.012 | 0.04 | 0.05 | 0.01 |
| N | Ni | B | Nb | Sn | Ti | Cu | |
| 0.004 | 0.06 | 0.0004 | 0.005 | 0.015 | 0.08 | 0.08 | |

Remainder iron and unavoidable impurities, contents in wt. %

The flat steel product, from which sample E1 was taken, was provided on its surfaces with a Zn—Al—Mg coating ("ZM coating") in a conventional manner by hot dip coating which is formed from 1.6 wt. % Al, 1.2 wt. % Mg and remainder Zn and unavoidable impurities.

The flat steel product, from which the sample E2 was taken, was provided on its surfaces with a Zn coating ("Z coating") in a conventional manner by hot dip coating which is formed from 0.6 wt. % Al and remainder Zn and unavoidable impurities.

On the other hand, the flat steel product, from which sample R was taken, was electrolytically coated in a conventional manner with a protective Zn-based coating which in the technical sense consisted entirely of zinc. Sample R served as a reference for testing the quality of the phosphate layers produced on samples E1 and E2, as explained below, in a manner according to the invention.

In a first test, the flat steel product samples E1, E2 were degreased in a conventional degreasing system in an equally conventional manner using a mildly alkaline cleaning agent.

The flat steel product samples E1, E2 were then wetted with an acidic cleaning agent commercially available under the name "BONDERITE® C-IC 124N" or "Ridoline® 124N" (see those available from Henkel KGaA at URL http://www.ktl-wob.de/fileadmin/user_upload/Randspalte/Performanceen/Strahlen/Ridoline_124_N-GA.pdf (instructions for use made available for download on Jan. 9, 2006, found on Oct. 30, 2019) by dipping or spraying said cleaner on the surface of their ZM coating to remove existing native oxide layers.

After this treatment, the flat steel product samples E1, E2 were rinsed in a conventional manner with deionized water in order to remove any residues of the acidic cleaning agent present on them.

For activation, the surfaces of the ZM coating on sample E1 and the Z coating on sample E2 cleaned in this way were sprayed with a solution containing 2.1 g/l of a conventional known "Fixodine®50CF" or "Bonderite® M-AC 50CF" activating agent at room temperature for a treatment period of 5 s.

The activated surfaces of the ZM coating of the flat steel product sample E1 and the Z coating of sample E2 were then sprayed for 5 s with a phosphating solution of which the temperature is 60° C. and in which 2.2 g/l nickel, 2 g/l manganese, 8.6 g/l phosphorus, 2.6 g/l zinc and 13.1 g/l nitrate are dissolved in water. The pH of the phosphating solution was 2.55.

The flat steel product samples E1 and E2 phosphated in this way were sprayed with deionized water for 20 s in order to remove residues of the phosphating agent.

Finally, samples E1, E2 were dried in a drying cabinet at 70° C.

With the exception of the pickling and rinsing carried out according to the invention, the reference sample R was treated in the same way as the other samples.

Figure 2A:
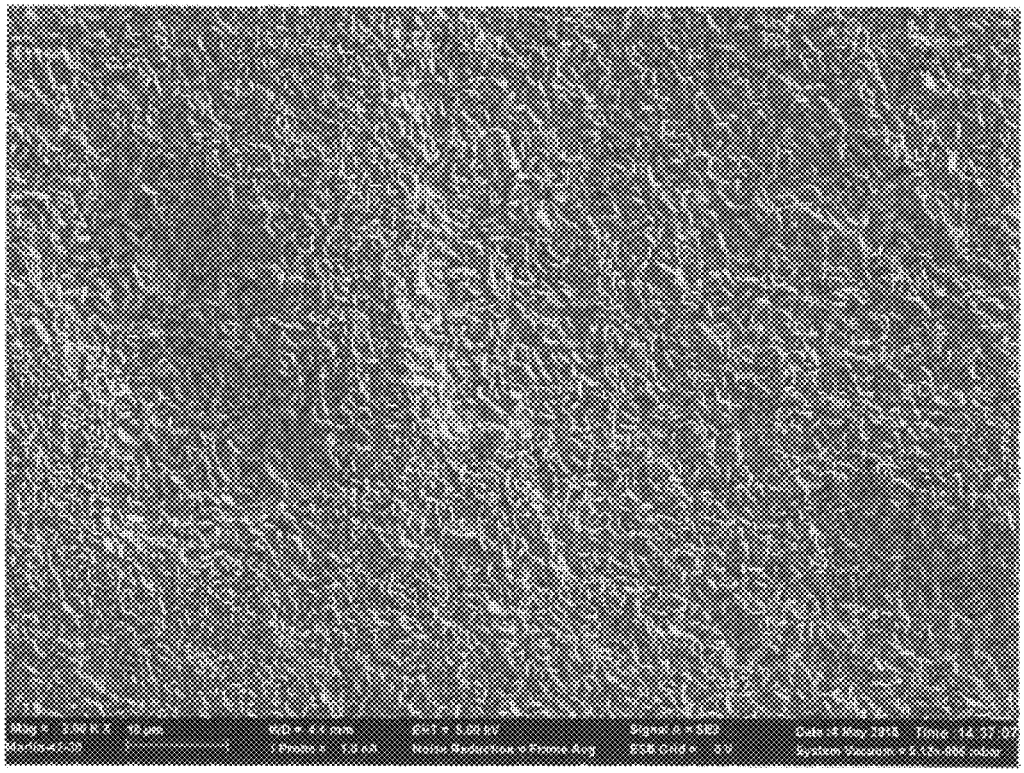
FIG. 2*a* shows an image, taken with a field emission scanning electron microscope ("FE-SEM"), of a surface of a ZM coating treated according to the invention.

FIG. 2*a* shows an FE-SEM image of a section of a surface of the ZM coating of the flat steel product sample E1 treated in the manner explained above.

Figure 2B:
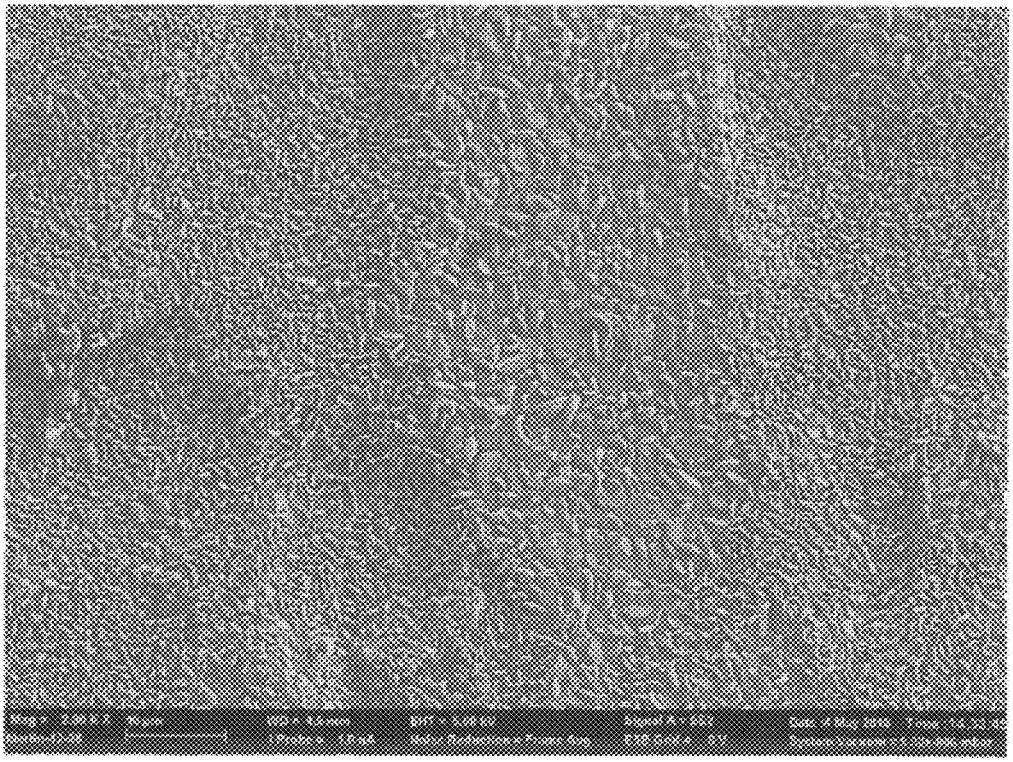
FIG. 2*b* shows an image, taken with a field emission scanning electron microscope ("FE-SEM"), of a surface of a Z coating treated according to the invention.

FIG. 2*b* shows an FE-SEM image of a section of a surface of the Z coating of the flat steel product sample E2 treated in the manner explained above.

Figure 2C:
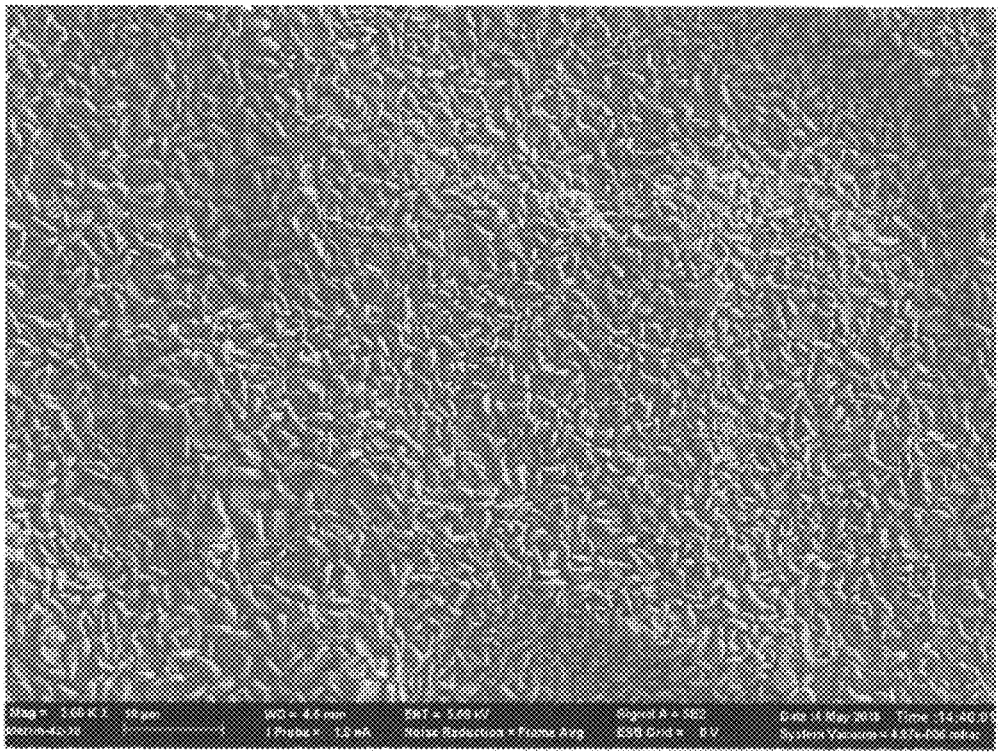
FIG. 2*c* shows an image, taken with a field emission scanning electron microscope ("FE-SEM"), of a surface of a zinc-based coating which has been electrolytically deposited on a sample.

FIG. 2*c* shows an FE-SEM image of a section of a surface of an electrolytically deposited Zn-based coating of the flat steel product sample R (reference) treated in the manner explained above.

A comparison of FIG. 2*a*-2*c* makes it clear that, using the treatment according to the invention, it is possible to reliably produce a fine-crystalline, covering phosphate layer on protective Zn-based coatings of flat steel products produced by hot-dip coating (see FIGS. 2*a* and 2*b*), which can otherwise only be achieved with electrolytically deposited Zn coatings (see FIG. 2*c*).

Figure 3:
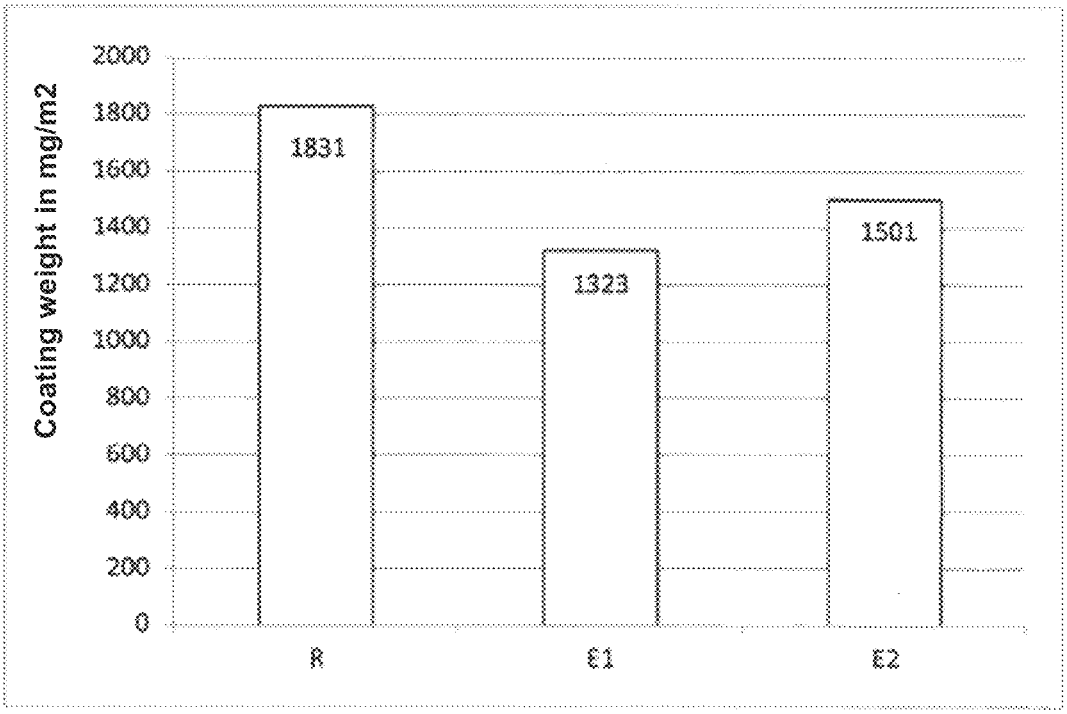
FIG. 3 shows a diagram which reproduces the coating weights determined for three samples.

This result was confirmed by determining the coating weights of the phosphate layers produced on samples E1, E2 and R using glow discharge spectroscopy (Glow Discharge Optical Emission Spectroscopy, GDOS/GDOES). The coating weights of the total coating determined for samples E1, E2 and R are presented in the diagram shown in FIG. 3. It can be seen that the phosphating, prepared and carried out according to the invention, of the coatings of the flat steel product samples E1 and E2 produced by hot dip coating leads to coating weights which differ only slightly from the coating weight of the phosphate layer which has been conventionally produced on the electrolytically coated reference sample R.

Figure 4:
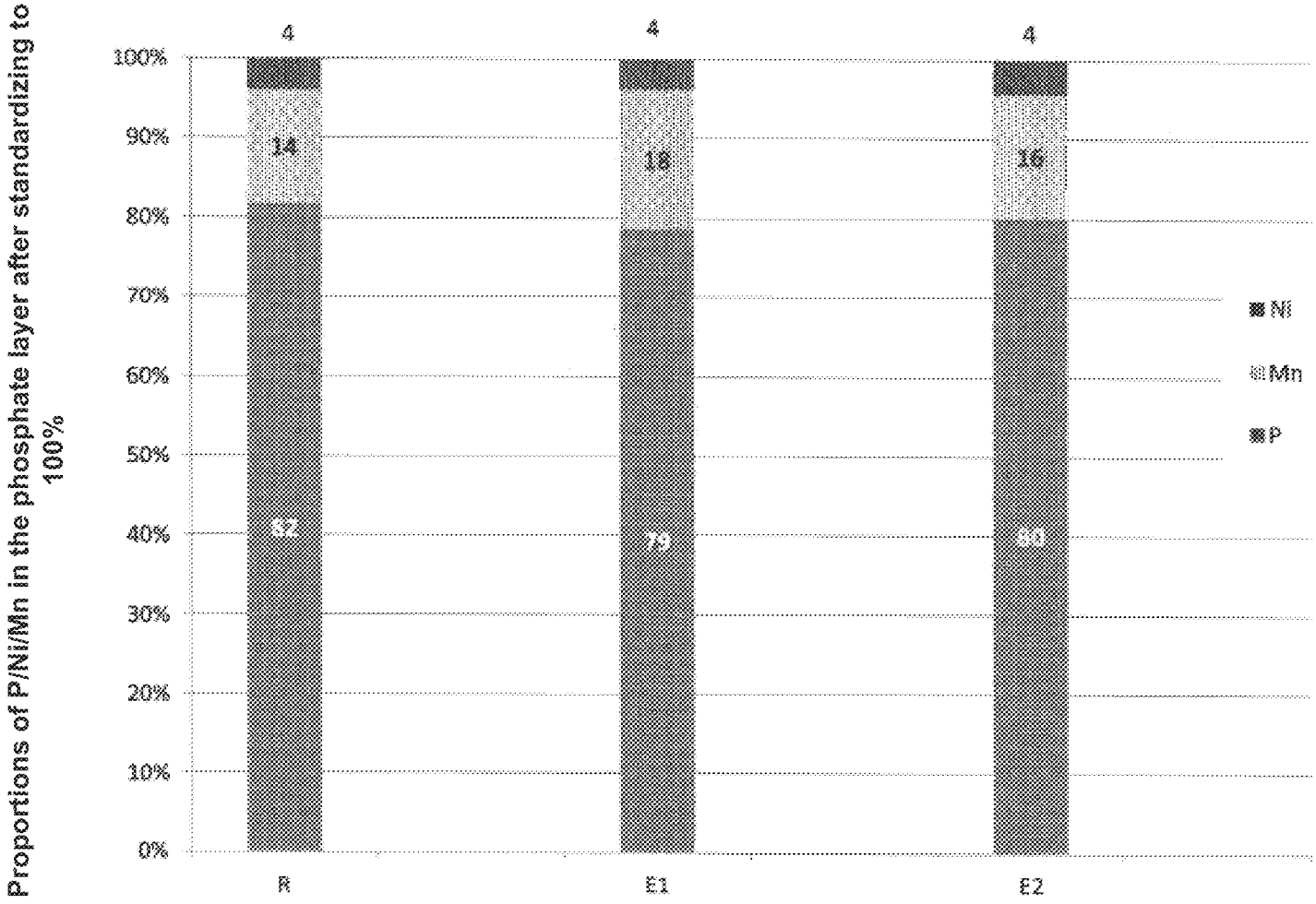
FIG. 4 shows a diagram which presents the contents of P, Ni and Mn in a phosphor coating produced on the samples, determined on three samples.

The proportions of the contents of P, Mn and Ni were also determined for the phosphate layers produced on samples E1, E2 and R. The measurements were carried out with a glow discharge spectrometer "Spectruma GDA750" (simultaneous vacuum spectrometer with a focal length of 750 mm and a Grimm-type discharge source and the possibility of measuring in DC and RF modes). The measurement was carried out in RF mode. The device was operated with a 4 mm anode and Argon 5.0 (99.999%) gas. Typical parameters of each device for operation with a 4 mm anode were a voltage of 800 V, a current of 20 mA, a power of 16 W and a lamp pressure of 3-10 hPa. In addition, a pre-plasma was connected upstream for a period of 25 s as part of the measurements. The results of this investigation are summarized in the diagram attached as FIG. 4. From this it can be seen that the phosphate layers produced according to the invention on samples E1 and E2 each coated with a hot dip Zn coating have the same compositions in the technical sense as reference sample R, which was provided with a protective Zn-based coating by electrolytic coating.

In order to evaluate the improvement in tribological behavior achieved by the phosphor layer produced according to the invention, samples E1, E2 and reference sample R as well as two comparison samples C1, C2 were subjected to what is known as a "pin-on-disk" test. Comparison sample C1 was a sample of the flat steel product provided with a ZM coating, from which sample E1, additionally coated with a phosphor layer in the manner according to the invention, also originated. Accordingly, comparison sample C2 was a sample of the flat steel product provided with a Z coating, from which sample E2, additionally coated with a phosphor layer in the manner according to the invention, also originated. Both the surfaces of the upper sides of samples E1, C1, E2, C2, R and their lower sides were examined.

Before the pin-on-disk test, all samples E1, C1, E2, C2, R were oiled with a commercially available oil. The oil was the oil offered by Fuchs Schmierstoff GmbH under the name "ANTICORIT PL 3802-39/S" which has been tried and tested for this purpose and was applied with a coating of 1.2 $g/m^2$ per surface of the samples E1, C1, E2, C2, R examined.

In the pin-on-disk test, the conical tip of a test specimen is pushed with a normal force N onto the surface of a circular disk-shaped section of the relevant sample which was rotated about an axis of rotation oriented vertically and normally to the surface exposed to the specimen. The frictional force between the test specimen and the surface of the sample blank is measured and the coefficient of friction is calculated from the determined frictional force and the normal force N. For the pin-on-disk test, a test specimen with a cone diameter of 5 mm was used; the test specimen consisted of the steel material known as 100 Cr6 (W3) and was heated to 60° C. for the tests. The normal force N, with which the tip of the test specimen was directed against the examined surface, was 30 N.

The results of the pin-on-disk tests are summarized in Table 2. It is evident that the samples E1, E2 coated according to the invention with a phosphating layer not only have a more favorable coefficient of friction u compared to the comparison samples C1, C2, but also compared to the comparison sample R.

TABLE 2

| Sample | Coating | Oil | Coefficient of friction [μ] Upper Side | Coefficient of friction [μ] Lower Side | According to the invention |
|---|---|---|---|---|---|
| E1 | ZM + P | PL3802 | 0.116 | 0.107 | YES |
| C1 | ZM | | 0.158 | 0.138 | NO |
| E2 | Z + P | | 0.132 | 0.128 | YES |
| C2 | Z | | 0.306 | 0.296 | NO |
| R | ZE + P | | 0.146 | 0.146 | NO |

Finally, the suitability of the samples E1, E2 phosphated according to the invention was examined in comparison to the non-phosphated samples C1, C2 and the reference sample R.

Before gluing, the samples E1, C1, E2, C2, R with a coating weight of 1.2 $g/m^2$ were oiled with an oil known for this purpose, which was available from Fuchs Schmierstoff GmbH under the name "ANTICORIT PL 3802-39/S."

The adhesive used in the tests was a commercially available structural adhesive known as "Betamate 120 EU," which is widely used in the manufacture of automobile bodywork. The tensile shear test is based on DIN EN 1465. In order to ensure a representative relevance of the results of the investigations, five identically treated copies of the samples E1, C1, E2, C2, R were examined.

The break behavior is evaluated according to DIN EN ISO 10365. A distinction is made between three types of break:

cohesive failure ("CF" for short), where the break occurs in the adhesive, adhesive failure ("AF" for short), where the break occurs at the interface between the oxide layer and the adhesive, and substrate close cohesive failure ("SCF"), where the break occurs in the adhesive near the interface between the oxide layer and the adhesive.

The higher the proportion of cohesive failure "CF," the higher the proportion of adhesive bonds which meet the practical requirement that an adhesive bond should fail in the region of the adhesive itself and not at the interface between the surface of the relevant component and the adhesive.

Figure 5:
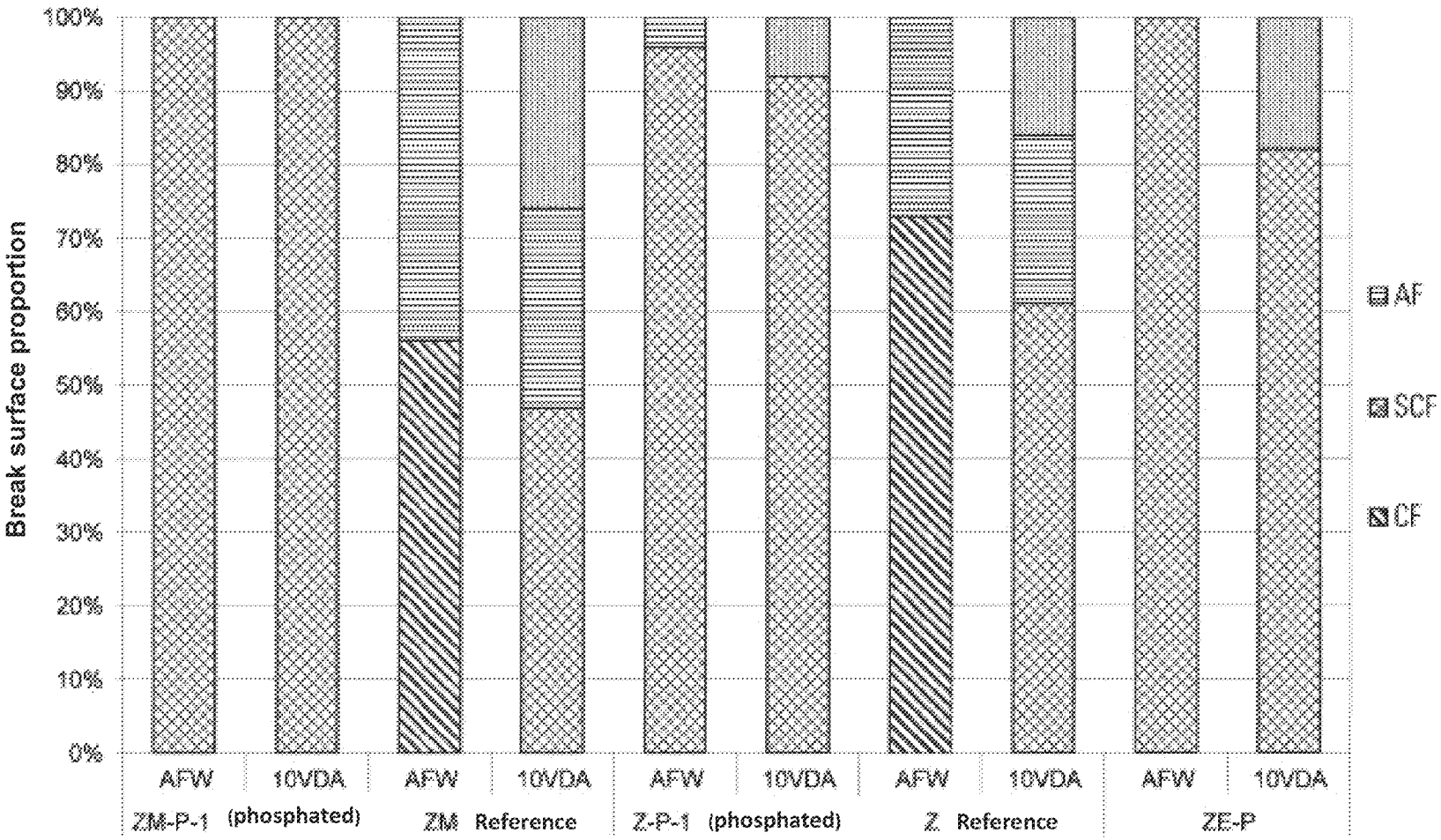
FIG. 5 shows a diagram which presents the results of tests on the adhesive behavior of 5 samples.

The results of the examinations of the adhesive behavior are summarized in FIG. 5. The results which were determined for samples in the initial state are identified by the word "AFW," whereas the results which were determined for samples that have undergone a climate change test in 10 cycles according to DIN EN ISO 11997-B are marked with "10VDA."

It is found that, measured by the proportion of the cohesive fracture pattern, the adhesive suitability of the samples E1, E2 phosphated according to the invention is significantly improved compared to the non-phosphated samples C1, C2 and the reference sample.

The invention claimed is:

1. A method for producing a flat steel product having a protective zinc-based metal layer and a phosphating layer produced on a surface of the protective metal layer, comprising at least the following method steps which are carried out in a continuous process:

a) providing a flat steel product, wherein a protective metal layer formed from a Zn—Al alloy consisting of Zn and 0.1-0.5 weight percent (wt. %) Al and unavoidable impurities, a Zn—Mg alloy, or a Zn—Mg—Al alloy containing in total up to 8 wt. % Mg and Al by hot dip coating is present on at least one side of the flat steel product;

b) at least partly removing a native oxide layer present on the surface of the protective metal layer by wetting this surface with an acidic solution having a pH of 1-3.5 for a wetting period of 1-60 seconds, wherein, for the acidic solution, an acid selected from the group consisting of sulfuric acid, sulfurous acid, hydrochloric acid, phosphoric acid, phosphonic acid, nitric acid, formic acid, oxalic acid, acetic acid, citric acid, malic acid, tartaric acid, nitrous acid and hydrofluoric acid is used;

c) optionally, rinsing the surface of the protective metal layer wetted with the acidic solution with an aqueous rinsing solution;

d) activating the surface of the protective metal layer by applying an aqueous activation solution to the surface of the protective metal layer; and e) phosphating the activated surface of the protective metal layer by applying an aqueous phosphating solution to the activated surface of the protective metal layer for a wetting period of 10 s or less.

2. The method according to claim 1, wherein, in work step b), the surface of the protective metal layer is wetted with the acidic solution in a spraying, coating, or dipping method.

3. The method according to claim 1, wherein the wetting period in work step b) is 1-15 seconds.

4. The method according to claim 1, wherein the acidic solution is heated to a wetting temperature of 20-95° C. before the surface of the protective metal layer is wetted.

5. The method according to claim 1, wherein in optional work step c), fully desalinated water is used as the aqueous rinsing solution.

6. The method according to claim 1, wherein the aqueous activation solution of step d) contains 0.8-25 g/l of at least one compound selected from the group consisting of titanium dioxide, titanium dioxide hydrate, dipotassium hexafluorotitanate, hexafluorotitanic acid, titanium sulfate, titanium disulfate, titanyl sulfate, titanium oxide sulfate, titanyl chloride, titanium potassium fluoride, titanium tetrachloride, titanium tetrafluoride, titanium trichloride, titanium hydroxide, titanium nitrite, titanium nitrate, potassium titanium oxide oxalate, and titanium carbide.

7. The method according to claim 1, wherein the aqueous phosphating solution of step e) contains 5-20 g/l phosphoric acid, 1-20 g/l orthophosphate and/or dihydrogen phosphate, 0.5-6 g/l zinc salt, 0.5-2 g/l manganese salt, 0.5-2 g/l nickel salt, and the remainder being water and unavoidable impurities.

8. The method according to claim 1, wherein at most 300 seconds elapse between the end of work step a) and the start of work step d).

9. The method according to claim 2, wherein the wetting period in work step b) is 1-15 seconds.

10. The method according to claim 2, wherein the acidic solution is heated to a wetting temperature of 20-95° C. before the surface of the protective metal layer is wetted.

11. The method according to claim 3, wherein the acidic solution is heated to a wetting temperature of 20-95° C. before the surface of the protective metal layer is wetted.

12. The method according to claim 2, wherein in optional work step c), fully desalinated water is used as the aqueous rinsing solution.

13. The method according to claim 3, wherein in optional work step c), fully desalinated water is used as the aqueous rinsing solution.

14. The method according to claim 4, wherein in optional work step c), fully desalinated water is used as the aqueous rinsing solution.

15. The method according to claim 2, wherein the aqueous activation solution of step d) contains 0.8-25 g/l of at least one compound selected from the group consisting of titanium dioxide, titanium dioxide hydrate, dipotassium hexafluorotitanate, hexafluorotitanic acid, titanium sulfate, titanium disulfate, titanyl sulfate, titanium oxide sulfate, titanyl chloride, titanium potassium fluoride, titanium tetrachloride, titanium tetrafluoride, titanium trichloride, titanium hydroxide, titanium nitrite, titanium nitrate, potassium titanium oxide oxalate and titanium carbide.

16. The method according to claim 3, wherein the aqueous activation solution of step d) contains 0.8-25 g/l of at least one compound selected from the group consisting of titanium dioxide, titanium dioxide hydrate, dipotassium hexafluorotitanate, hexafluorotitanic acid, titanium sulfate, titanium disulfate, titanyl sulfate, titanium oxide sulfate, titanyl chloride, titanium potassium fluoride, titanium tetrachloride, titanium tetrafluoride, titanium trichloride, titanium hydroxide, titanium nitrite, titanium nitrate, potassium titanium oxide oxalate and titanium carbide.

17. The method according to claim 1, wherein the protective metal layer on at least one side of the flat steel product provided in work step a) contains Zn, $MgZn_2$, and/or Al-rich Zn phases.

18. The method according to claim 1, wherein the protective metal layer on at least one side of the flat steel product provided in work step a) has Al and/or Mg oxides on its surface.

19. The method according to claim 1, wherein the native oxide layer present on the surface of the protective metal layer on at least one side of the flat steel product provided in work step a) is completely removed in the technical sense in work step b).

20. The method according to claim 1, wherein the protective metal layer on at least one side of the flat steel product provided in work step a) is formed from a Zn—Mg—Al alloy containing in addition to Zn and unavoidable impurities, 0.1-3.0 wt. % Mg, and 0.1-5.0 wt. % Al.

* * * * *